US005161695A

United States Patent [19]

Roos

[11] Patent Number: 5,161,695

[45] Date of Patent: Nov. 10, 1992

[54] METHOD AND APPARATUS FOR SEPARATING PARTICULATE MATERIAL ACCORDING TO CONDUCTIVITY

[76] Inventor: Edwin H. Roos, 1 Cotswold, 25 Cotswold Road, Florida Hills, Florida, Transvaal, South Africa

[21] Appl. No.: 869,206

[22] Filed: Apr. 13, 1992

Related U.S. Application Data

[63] Continuation of Ser. No. 624,334, Dec. 7, 1990, abandoned.

[30] Foreign Application Priority Data

Dec. 7, 1989 [ZA] South Africa ..... 89/9361

[51] Int. Cl.[5] ..... B03B 1/00

[52] U.S. Cl. ..... 209/11; 209/2; 209/212; 209/217; 209/232

[58] Field of Search ..... 209/2, 3, 8, 9, 11, 209/39, 212, 214, 217, 232, 478

[56] References Cited

U.S. PATENT DOCUMENTS

| | | | |
|---|---|---|---|
| 481,683 | 8/1892 | Aylsworth et al. | 209/8 X |
| 3,097,160 | 7/1963 | Rich | 209/11 X |
| 3,463,310 | 8/1969 | Ergun et al. | 209/214 X |
| 3,702,133 | 11/1972 | Vibert et al. | 209/214 |
| 4,062,767 | 12/1977 | Rudy | 209/212 |
| 4,137,156 | 1/1979 | Morey et al. | 209/212 |
| 4,214,984 | 7/1980 | MacElvain | 209/214 |
| 4,229,209 | 10/1980 | Kindig et al. | 209/9 |
| 4,416,771 | 11/1983 | Henrigues | 209/39 X |
| 4,842,721 | 6/1989 | Schloemann | 209/212 |
| 5,064,075 | 11/1991 | Reid | 209/212 X |

FOREIGN PATENT DOCUMENTS

| | | | |
|---|---|---|---|
| 2336035 | 2/1975 | Fed. Rep. of Germany . | |
| 52-74167 | 6/1977 | Japan . | |
| 1230691 | 5/1986 | U.S.S.R. | 209/212 |
| 1233937 | 5/1986 | U.S.S.R. | 209/212 |

*Primary Examiner*—Andres Kashnikow
*Assistant Examiner*—Joseph A. Kaufman
*Attorney, Agent, or Firm*—Scully, Scott, Murphy & Presser

[57] ABSTRACT

Non-magnetic, conductive particles are separated from one another on the basis of their respective electrical conductivities. This is achieved by irradiating the particles with microwave or radio frequency electromagnetic radiation and simultaneously subjecting the particles to a magnetic field. The eddy currents induced in the particles by the electromagnetic irradiation interact with the magnetic field to cause movements of the particles which are dependent on their conductivities.

10 Claims, 1 Drawing Sheet

FIG 1
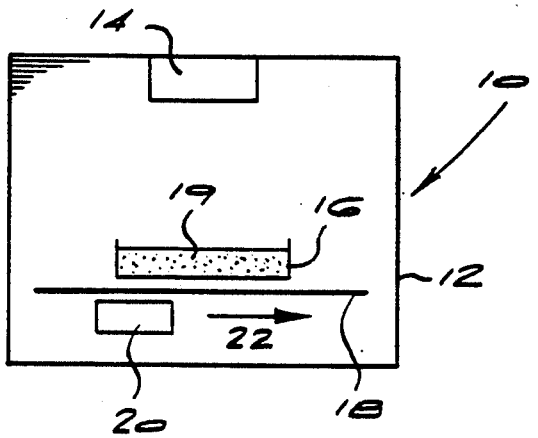
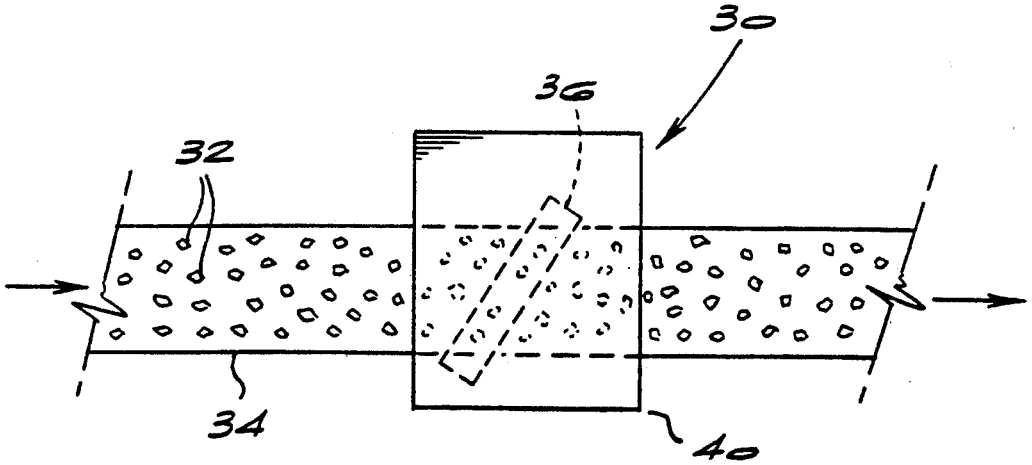
FIG 2

METHOD AND APPARATUS FOR SEPARATING PARTICULATE MATERIAL ACCORDING TO CONDUCTIVITY

This is a continuation of copending application Ser. No. 624,334 filed on Dec. 7, 1990, now abandoned.

BACKGROUND TO THE INVENTION

This invention relates to a method and means for separating materials.

Mining operations almost invariably involve the extraction of valuable minerals which exist in very small quantities in the mined rock. This is particularly so in the case of valuable metals such as gold and silver.

It is therefore considered that it would be advantageous to have a method and means whereby non-magnetic, electrically conductive materials such as gold and silver can be separated from other materials.

SUMMARY OF THE INVENTION

The invention provides a method of separating particulate material according to the electrical conductivity of the particles of the material, the method comprising irradiating the particles with microwave or radio frequency electromagnetic radiation and subjecting the irradiated particles to a magnetic field so that eddy currents induced in the particles by the electromagnetic radiation interact with the magnetic field to cause movements, dependent upon electrical conductivity, of electrically conductive particles.

The particles are preferably irradiated with microwave radiation having a frequency in the range $10^9$ Hz to $3\times10^{11}$ Hz, or by radio wave radiation having a frequency in the range $10^4$ Hz to $10^9$ Hz.

The magnetic field may be a moving or stationary field. In addition, the magnetic field may have a constant or varying intensity.

In one version of the invention, the particles are passed through a microwave chamber in which they are irradiated with microwave radiation and in which they are subjected to the magnetic field. In another version of the invention, the particles are held in suspension in a liquid and are subjected to microwave irradiation and the magnetic field while so suspended.

The method of the invention can be used to separate gold particles from other particles.

The invention also provides an apparatus for separating particulate material according to the electrical conductivities of the particles of the material, the apparatus comprising means for irradiating the particles with microwave or radio frequency electromagnetic radiation and means for subjecting the irradiated particles to a magnetic field so that eddy currents induced in the particles by the electromagnetic radiation interact with the magnetic field to cause movements of electrically conductive particles dependent on their conductivities.

BRIEF DESCRIPTION OF THE DRAWINGS

The invention will now be described in more detail, by way of example only, with reference to the accompanying drawings in which:

FIG. 1 shows a diagrammatic side view illustrating a first embodiment of the invention; and FIG. 2 shows a diagrammatic plan view of a second embodiment of the invention.

DESCRIPTION OF EMBODIMENTS

FIG. 1 shows an apparatus 10 which illustrates the principles of the method of the invention. The Figure illustrates a microwave chamber 12 in which is mounted a microwave generator 14 for generating microwaves having a frequency in the range $10^9$ Hz to $3\times10^{11}$ Hz.

A glass dish 16 is placed on a conductive shielding plate 18 in the chamber 12 and contains an aqueous colloidal suspension 19 of fine gold particles together with other non-magnetic, non-conductive particles.

A permanent magnet 20 is placed beneath the conductive plate 18 and means (not shown) are provided for moving the magnet in the direction of the arrow 22 in FIG. 1. The magnetic field lines associated with the magnet 20 are vertical in FIG. 1.

With the microwave generator in operation, the magnet is caused to move in the direction of the arrow 22. The microwaves induce eddy currents in the gold particles in suspension. Such eddy currents interact with the moving magnetic field and give rise to an electromotive force which in this case urges the gold particles to move to the right in FIG. 1, i.e. in the same direction as the magnet moves.

No eddy currents are induced in the non-conductive particles which are also in suspension with the gold particles, and such particles remain in their original positions in the suspension. Thus a separation of the gold particles from the non-conductive particles is achieved.

The extent to which conductive particles are moved by the interaction of the induced eddy currents and the moving magnetic field is dependent, inter alia, on the conductivity of those particles. It will be appreciated that particles with lower electrical conductivities such as, say, aluminum particles will be moved to a lesser extent than highly conductive particles such as gold particles. Thus it is not only possible to achieve a separation between conductive and non-conductive particles, but it is also possible to achieve a separation between particles of different electrical conductivity. In cases where it is desired to achieve the latter kind of separation with an apparatus such as that of FIG. 1, the particles of different conductivities will be grouped, after a period of time, in different zones of the dish 16.

In cases where it is desired to separate one particular kind of particle, such as gold particles, from other particles, the microwave frequency will be chosen to induce eddy currents of the desired magnitude in the desired particles so that the movement of those particles can be predicted and the desired particles recovered apart from other particles. In other words, the desired particles will be specifically targeted. On the other hand, where it is desired to make a general discrimination between various particle types having different thermal conductivities, a non-specific microwave frequency may be used to cause differing degrees of movement of the various particle types.

An apparatus such as that of FIG. 1 can be of practical benefit in assay procedures where it is desired, for instance, to determine the gold content of an ore sample. In such a case, the gold fraction is recovered and a computation may be made of the gold content of the sample as a whole.

In the high throughput apparatus 30 depicted diagrammatically in plan view in FIG. 2, milled and crushed ore particles 32 are fed onto an endless conveyor belt 34. The ore particles 32 contain a low concentration of small particles of valuable electrically conductive material, such as gold, which are to be separated from other non-conductive material or less conductive materials in the mass of ore particles.

During their travel on the belt, the particles pass through a microwave chamber 40 in which they are subjected to microwave radiation having a frequency in the range $10^9$ Hz to $3\times10^{11}$ Hz. While being irradiated the particles pass between magnets 36 (only one visible in FIG. 2) located above and below the belt 34. The magnets may be shielded from the microwaves by plates similar to the plate 18 of FIG. 1. The field lines associated with the magnets are perpendicular to the belt, i.e. into the plane of the paper in FIG. 2.

As illustrated, the magnets 36 are arranged at 45° to the direction of belt movement, indicated by the arrows 38. Thus the magnetic field itself is at 45° to the direction of movement of the belt and particles.

The incident microwave radiation induces eddy currents in conductive particles. These eddy currents interact with the applied magnetic field to produce forces which tend to move the conductive particles sideways off the belt. The exact frequency of the microwaves is chosen to produce eddy currents of sufficient magnitude in small conductive particles for the resultant electromotive force to be great enough to cause the relevant particles to fall sideways off the belt.

The remaining particles, which are either non-conductive or less conductive than the particles which it is desired to separate are not moved off the belt and continue moving on the belt. Such particles are discharged over the discharge end of the belt for collection separately from those particles moved sideways off the belt.

The magnets 36 seen in FIG. 2 may be arranged to move in a direction at right angles to the direction of movement of the belt up and down as viewed in FIG. 2. Also, there can be a number of magnets 36 arranged side-by-side to produce a "sweeping" magnetic field acting on the particles. A sweeping electromotive force, resulting from the interaction of the eddy currents with the magnetic fields of the various magnets moves the relevant particles progressively in a sideways direction off the belt.

In cases such as that exemplified in FIG. 2, it will be appreciated that the physical nature of the particles, in addition to their conductivities, will also determine the extent to which they are moved. For instance, a lighter particle may be moved more easily than a heavier particle, even though the latter particle may have a higher conductivity than the former. Such factors will of course have to be taken into account in the design of a particular particle separation installation.

As indicated previously, the invention is not limited to the use of microwave frequency electrmagnetic radiation. Radio frequency electromagnetic radiation, in the frequency range $10^4$ Hz to $10^9$ Hz can also be used.

I claim:

1. A method of separating particulate material according to the electrical conductivity of the particles of the material, the method comprising irradiating the particles with microwave or radio frequency electromagnetic radiation at a frequency selected to generate eddy currents at the surfaces of electrically conductive particles and at substantially the same time as such irradiation takes place, subjecting the irradiated particles to a magnetic field so that eddy currents induced temporarily in the particles by the electromagnetic radiation interact with the magnetic field to cause movements, dependent upon electrical conductivity, of electrically conductive particles.

2. A method according to claim 1 including the step of irradiating the particles with microwave radiation having a frequency in the range of $10^9$ Hz to $3\times10^{11}$ Hz.

3. A method according to claim 1 including the step of irradiating the particles with radio frequency radiation having a frequency in the range of $10^4$ Hz to $10^9$ Hz.

4. A method according to claim 1 wherein the magnetic field is a moving magnetic field.

5. A method according to claim 1 wherein the magnetic field is a stationary magnetic field.

6. A method according to claim 1 including the step of passing the particles through a microwave chamber in which they are irradiated with microwave radiation and in which they are substantially simultaneously subjected to the magnetic field.

7. A method according to claim 6 including the step of passing the particles through the microwave chamber on a conveyor belt.

8. A method according to claim 1 wherein the particles are held in suspension in a liquid and are subjected to microwave irradiation and the magnetic field while so suspended.

9. A method according to claim 1 wherein said particulate material is a combination of gold particles, and non-magnetic, non-conductive particles.

10. An apparatus for separating particulate material according to the electrical conductivities of the particles of the material, the apparatus comprising means for irradiating the particles with microwave or radio frequency electromagnetic radiation at a frequency selected to generate eddy currents at the surfaces of electrically conductive particles and means for subjecting the irradiated particles to a magnetic field at substantially the same time as such irradiation takes place so that eddy currents included temporarily in the particles by the electromagnetic radiation interact with the magnetic field to cause movements of electrically conductive particles dependent on their conductivities.

* * * * *